US008043046B2

(12) United States Patent
Guemmer

(10) Patent No.: US 8,043,046 B2
(45) Date of Patent: Oct. 25, 2011

(54) FLUID FLOW MACHINE WITH BLADE ROW-INTERNAL FLUID RETURN ARRANGEMENT

(75) Inventor: Volker Guemmer, Mahlow (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 390 days.

(21) Appl. No.: 12/385,767

(22) Filed: Apr. 17, 2009

(65) Prior Publication Data

US 2009/0263233 A1 Oct. 22, 2009

(30) Foreign Application Priority Data

Apr. 18, 2008 (DE) ..... 10 2008 019 603

(51) Int. Cl.
*F01D 5/14* (2006.01)

(52) U.S. Cl. ..... 415/115; 415/141

(58) Field of Classification Search ..... 415/115, 415/141

See application file for complete search history.

(56) References Cited

U.S. PATENT DOCUMENTS 5,308,225 A * 5/1994 Koff et al. ..... 415/57.3
5,431,533 A * 7/1995 Hobbs ..... 415/58.7
5,474,417 A * 12/1995 Privett et al. ..... 415/58.5
5,607,284 A * 3/1997 Byrne et al. ..... 415/58.5
6,220,012 B1 * 4/2001 Hauser et al. ..... 60/772
7,077,623 B2 * 7/2006 Guemmer ..... 415/58.5
7,364,404 B2 * 4/2008 Guemmer ..... 416/91
7,811,049 B2 * 10/2010 Xu ..... 415/54.1
2005/0019152 A1 * 1/2005 Seitz ..... 415/58.5
2005/0226717 A1 * 10/2005 Xu ..... 415/58.5
2006/0104805 A1 * 5/2006 Gummer ..... 415/58.5
2006/0153673 A1 * 7/2006 Guemmer ..... 415/115
2008/0226439 A1 * 9/2008 Guemmer ..... 415/1

* cited by examiner

*Primary Examiner* — Jarrett Stark
*Assistant Examiner* — Nicholas Tobergte
(74) *Attorney, Agent, or Firm* — Timothy J. Klima; Shuttleworth & Ingersoll, PLC

(57) ABSTRACT

A fluid flow machine has a flow path (2) which is confined by at least one wall, on which at least one row of blades (6, 7) is fixedly mounted. At least one fluid offtake opening (9) and at least one fluid supply opening (10), which are connected by at least one fluid return path (11), are arranged in the wall in an area of a blade row (6, 7), with a circumferential extension of the fluid supply opening (10) being less than a distance between two adjacent blades.

20 Claims, 15 Drawing Sheets

State of the art

FLUID FLOW MACHINE WITH BLADE ROW-INTERNAL FLUID RETURN ARRANGEMENT

Figure 1:
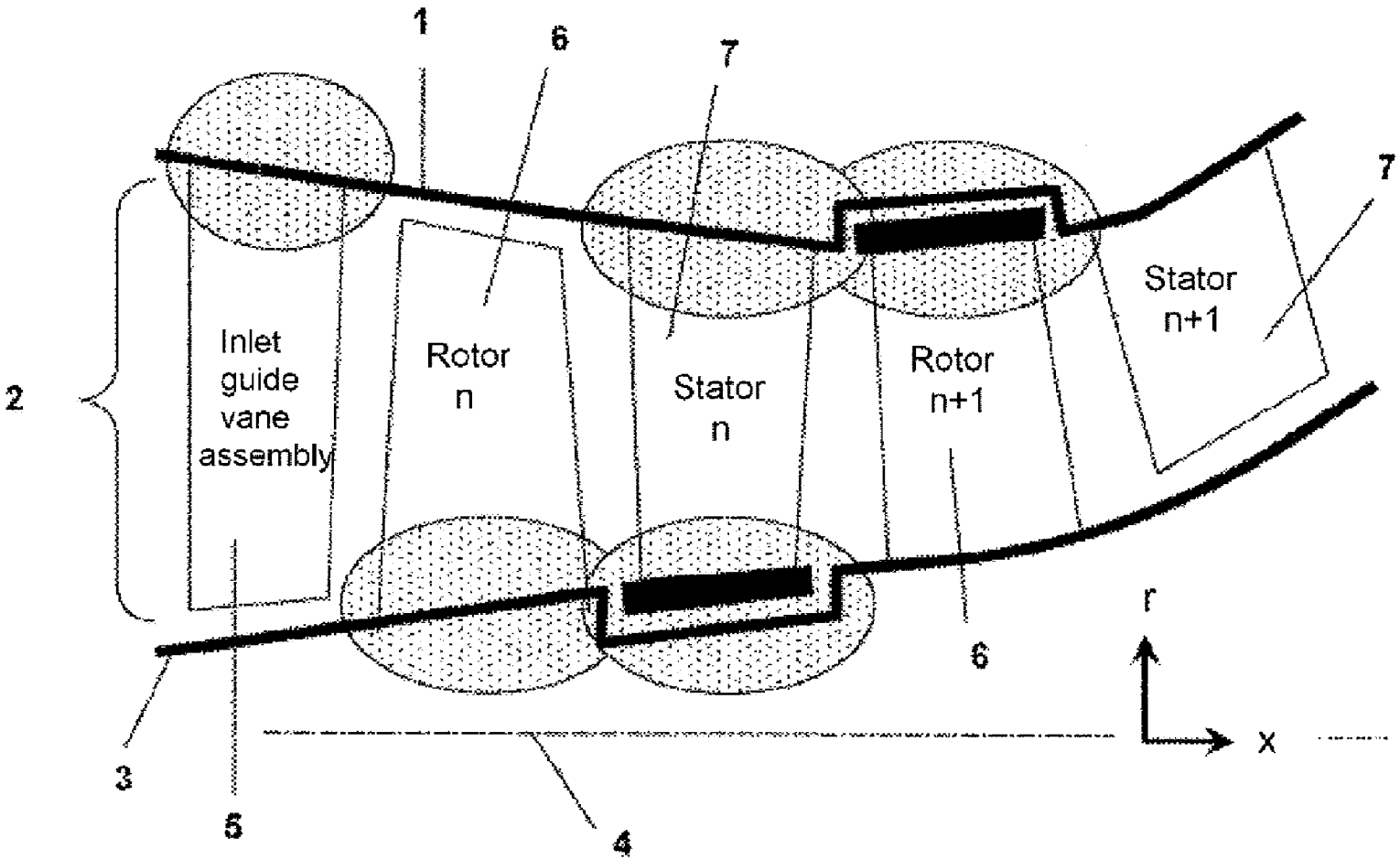

This application claims priority to German Patent Application DE102008019603.7 filed Apr. 18, 2008, the entirety of which is incorporated by reference herein.

The present invention relates to a fluid flow machine.

More particularly, this invention relates to a fluid flow machine with a flow path which is confined by at least one wall on which at least one row of blades (rotor blades or stator vanes) is arranged, with no relative movement being provided between the wall and the blades.

The aerodynamic loadability and efficiency of fluid flow machines, such as blowers, compressors, pumps and fans, is limited in particular by the growth and the separation of boundary layers near the casing wall.

To remedy this fundamental problem, the state of the art provides solutions only to a limited extent. The numerous concepts existing for fluid supply to the turbine blades essentially provide for surface cooling, not for energizing the boundary layers.

Concepts are known for compressors, in which air is supplied to the hub and casing via axially-symmetric slots, to influence the wall boundary layers there. In this process, air is removed at or within another downstream blade row and then returned (DE 10 2004 030 597 A1 and EP 1 382 855 B1) or supplied from the outside by means of an auxiliary unit.

While the general concept of influencing the boundary layers is contained in the state of the art, the known solutions are effective to only a limited extent and very restricted as regards their practical applicability. This is partly attributable to the high complexity of the boundary layer flow phenomena occurring in the sidewall area of fluid flow machines.

The present invention therefore relates to blades of fluid flow machines, such as blowers, compressors, pumps and fans of the axial, semi-axial and radial type using gaseous or liquid working media.

The fluid flow machine may include one or several stages, each having a rotor and a stator, in individual cases, the stage is formed by a rotor only.

The rotor includes a number of blades, which are connected to the rotating shaft of the machine and impart energy to the working medium. The rotor may be designed with or without shroud at the outward blade ends.

The stator includes a number of stationary vanes, which may either feature a fixed or a free blade end on the hub and on the casing side. Rotor drum and blading are usually enclosed by a casing, in other cases (e.g. aircraft or ship propellers) no such casing exists.

The machine may also feature a stator, a so-called inlet guide vane assembly, upstream of the first rotor. Departing from the stationary fixation, at least one stator or inlet guide vane assembly may be rotatably borne, to change the angle of attack. Variation is accomplished for example via a spindle accessible from the outside of the annulus duct. In a special configuration the fluid flow machine may have at least one row of variable rotors.

In an alternative configuration, multi-stage types of fluid flow machines according to the present invention may have two counter-rotating shafts, with the direction of rotation of the rotor blade rows alternating between stages. Here, no stators exist between subsequent rotors.

Finally, the fluid flow machine may—alternatively—feature a bypass configuration such that the single-flow annulus duct divides into two concentric annuli behind a certain blade row, with each of these annuli housing at least one further blade row.

The present invention relates to a fluid flow machine in which work is applied to the fluid.

If the fluid to be returned is removed at a location of the fluid flow machine which energetically has a distinctly higher level, efficiency is impaired as work is repeatedly applied to the same fluid. Furthermore, the transfer passages in usual recirculation of fluid between different blade rows generally are long and accordingly entail high pressure losses.

A broad aspect of the present invention is to provide a fluid flow machine of the type specified at the beginning above, which features improved flow characteristics and increased efficiency while being simply designed and easily and cost-effectively producible.

More particularly, the present invention therefore provides for a blade row-internal fluid return arrangement or a fluid return duct, which is as short as possible and extends through the sidewall of the respective blade row in the area of a blade end without circumferential relative movement between the blade and the sidewall confining the main flow path, with the offtake point being disposed in the area of the blade trailing edge or the blade pressure side and the supply point being disposed in the vicinity of the blade suction side.

Therefore, a fluid flow machine with a flow path which is confined by at least one wall on which at least one row of blades is fixedly mounted is provided in accordance with the present invention. Here, at least one fluid offtake opening and at least one fluid supply opening are arranged in the wall in an area of a blade row which are connected by at least one fluid return path, with the circumferential extension of the fluid supply opening being less than the distance between two adjacent blades.

Fluid return according to the present invention will become particularly effective if flow deflection of the respective blade row assumes a high value of more than 35°.

In accordance with the present invention, it is therefore provided to accomplish flow return in the area of a blade or blade row. This results in short flow paths for the return of fluid. Furthermore, the inclusion of the blade suction side and the blade pressure side enables the flow behavior to be positively optimized.

On fluid flow machines according to the present invention, an as yet unattained degree of space-saving boundary flow influencing is thus obtained which also enables a significant reduction of the constructional and cost investment. Depending on the degree of utilization of the concept, an increase in efficiency of up to 1% is obtainable.

In advantageous developments, it is provided that

- the centroid of the fluid supply opening, as viewed in the meridional flow direction, is provided upstream of the centroid of the fluid offtake opening,
- the fluid supply opening is at least partly provided downstream of the leading edge plane of the blade row,
- the fluid return path is arranged on a rotor blade row and/or a stator vane row including individual blades with a blade platform, with the rotor drum carrying the rotor blades and/or the casing carrying the stator vanes and the blade platform forming at least one cavity arranged beside the main flow path and at least one fluid supply opening connecting the at least one cavity with the main flow path being provided in at least one blade platform,
- at least one fluid offtake opening connecting the main flow path with at least one cavity is provided in at least one blade platform, at least one fluid offtake opening (9) connecting the main flow path (2) with the at least one cavity is provided between at least one blade platform and the rotor drum (3) and/or the casing, at least one blade of the blade row (6, 7) is variable about a blade rotary axis, with at least one cavity arranged beside the main flow path (2) and passed by the blade rotary axis being provided in the casing and/or the rotor drum (3), with at least one fluid supply opening (10) and/or at least one fluid offtake opening (9) being provided in at least one blade passage to connect the main flow path (2) with the cavity, the wall is partly formed by an inner shroud of a blade row (6, 7), with at least one cavity arranged beside the main flow path (2) being provided in the inner shroud, and with at least one fluid supply opening (10) and/or at least one fluid offtake opening (9) being provided in at least one blade passage to connect the main flow path (2) with the cavity, at least one fluid supply opening (10) includes a curved nozzle protruding into the main flow path (2), at least one fluid offtake opening (9) includes a curved ram inlet protruding into the main flow path.

In accordance with the present invention, it is particularly favorable on a fluid flow machine with at least one row of rotor blades or stator vanes and a sidewall formed by a casing or a hub contour of the main flow path of the fluid flow machine if:

a.) the sidewall adjoins at least one of the blade rows such that no relative movement in the circumferential direction is provided between the sidewall and the blade ends of the blade row, b.) an arrangement for blade row-internal fluid return is provided in the sidewall in the area of at least one of the blade ends without relative movement between blade and sidewall, c.) said arrangement for blade row-internal fluid return includes at least one fluid offtake opening within a zone of the sidewall essentially concentrated on the blade pressure side, at least one supply opening within a zone of the sidewall essentially concentrated on the blade suction side and at least one fluid return path in the sidewall, with the fluid return path connecting at least one offtake opening with at least one supply opening, d.) the fluid supply openings provided are arranged on a portion of the circumference of the fluid flow machine only, and in particular if the blade row provided with the arrangement for fluid return has a profile camber in at least one of its blade sections, i.e. an angular difference of the tangents drawn on the profile skeleton line at the leading and trailing edge, of at least 35°, at least one fluid offtake opening is provided within the extensive offtake zone EA1, at least one fluid supply opening is provided within the extensive supply zone IA1, at least one fluid offtake opening is provided within the restricted offtake zone EA2, at least one fluid supply opening is provided within the restricted supply zone IA2, the fluid offtake and fluid supply openings provided in a blade passage are arranged on different sides of the blade passage centerline, at least one fluid return path connects at least one offtake opening with a supply opening in another blade passage, at least one fluid return path connects at least one offtake opening with a supply opening in the same blade passage, fluid return is provided on a rotor blade row including individual blades with blade platform and circumferential root, with the rotor drum carrying the rotor blades and the rotor blade platforms forming at least one cavity arranged beside the main flow path, and with at least one supply opening connecting the at least one cavity with the main flow path being provided in at least one rotor blade platform, at least one offtake opening connecting the main flow path with the at least one cavity is provided in at least one rotor blade platform, at least one offtake opening connecting the main flow path with the at least one cavity is provided between at least one rotor blade platform and the rotor drum, fluid return is provided on a stator vane row including individual vanes with vane platform and circumferential root, with the casing carrying the stator vanes and the stator vane platforms forming at least one cavity arranged beside the main flow path, and with at least one supply opening connecting the at least one cavity with the main flow path being provided in at least one stator vane platform, at least one offtake opening connecting the main flow path with the at least one cavity is provided in at least one stator vane platform, at least one offtake opening connecting the main flow path with the at least one cavity is provided between at least one stator vane platform and the casing, fluid return is provided at the outer end of a stator vane row with vanes rotatably borne in the casing, at least one cavity arranged beside the main flow path and passed by the vane rotary axis is provided in the casing, at least one supply opening connecting the at least one cavity with the main flow path is provided in at least one stator vane passage, and at least one offtake opening connecting the main flow path with the at least one cavity is provided in at least one stator vane passage, fluid return is provided at the inner shroud of a stator vane row with fixed or rotatably borne vanes, at least one cavity arranged beside the main flow path is provided in the inner shroud, at least one supply opening connecting the at least one cavity with the main flow path is provided in at least one stator vane passage, and at least one offtake opening connecting the main flow path with the at least one cavity is provided in at least one stator vane passage, at least one supply opening produces a fluid jet directed essentially tangentially along the sidewall, at least one supply opening has the form of, ideally, a curviform nozzle being flush with the surface or also protruding into the main flow path, at least one offtake opening has the form of, ideally, a curviform ram inlet protruding into the main flow path, at least one fluid return path has at least one branch for splitting the recirculated fluid to several supply openings, at least one fluid return path has a continuously contracting cross-section in flow direction in at least part of its course, the sum of the cross-sectional areas of all offtake openings is larger than the sum of the cross-sectional areas of all supply openings.

Figure 4:
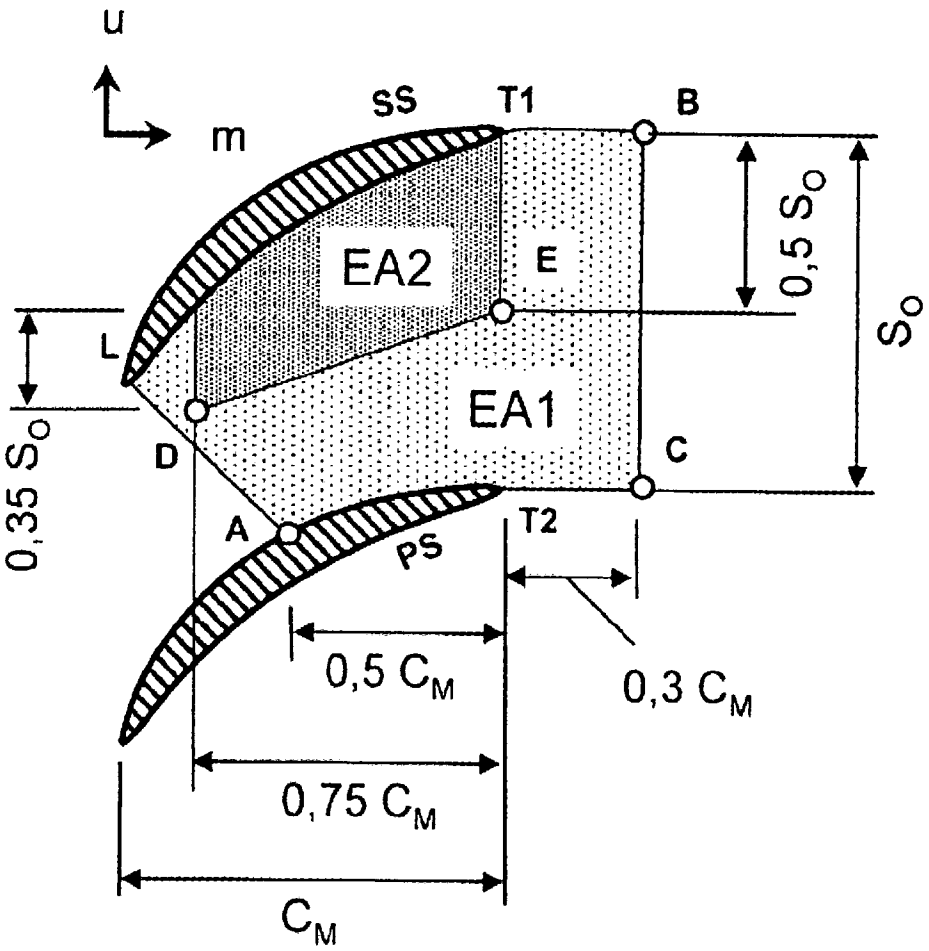
Figure 4:
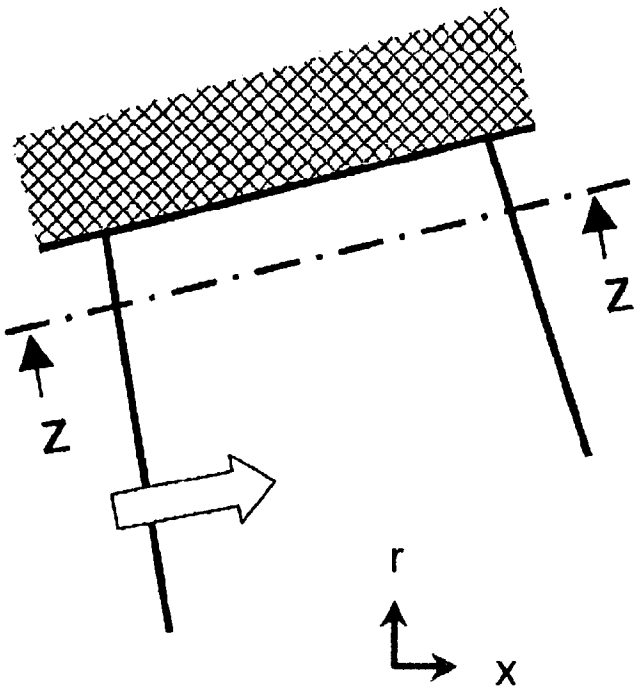
Figure 5:
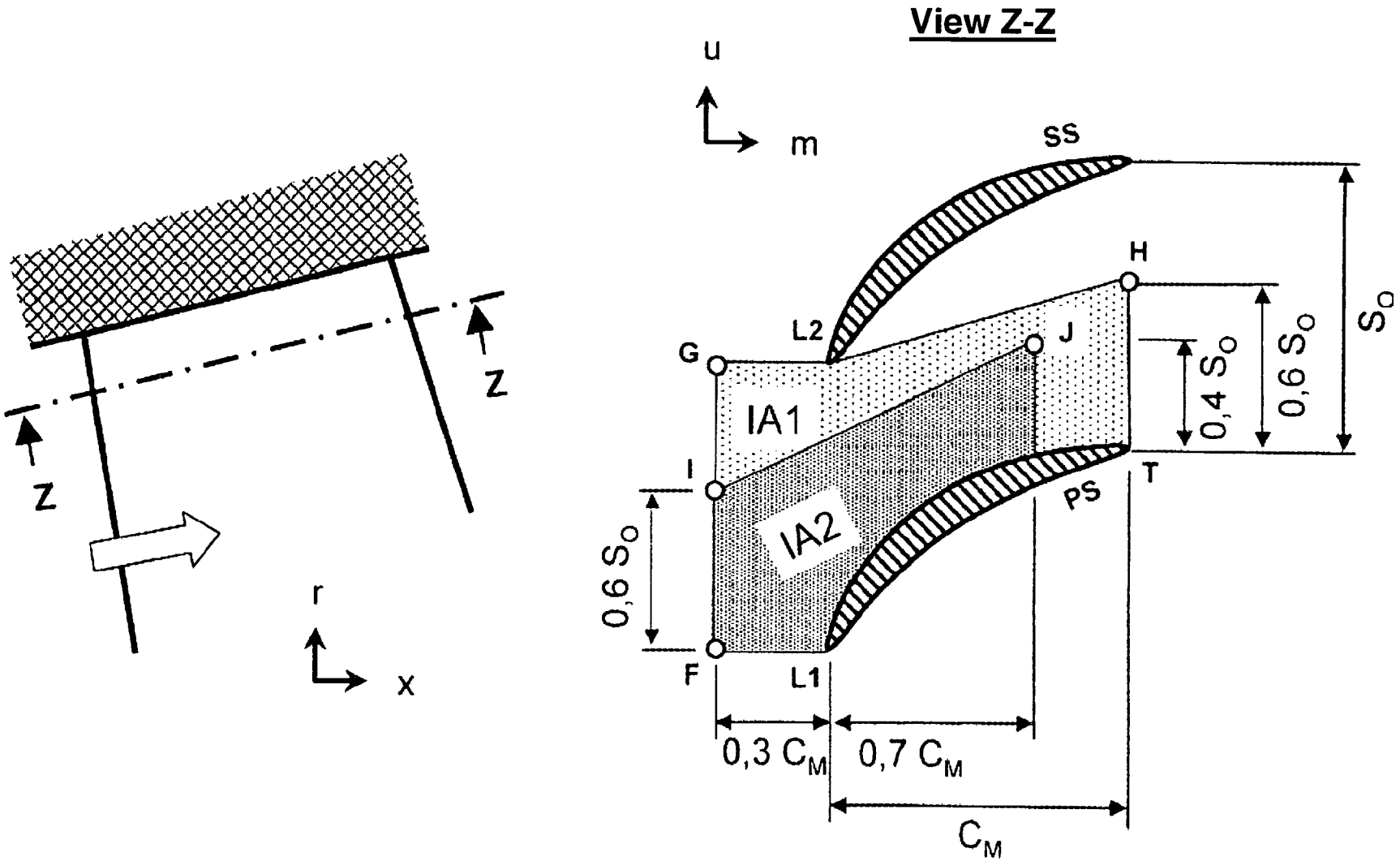
Figure 6:
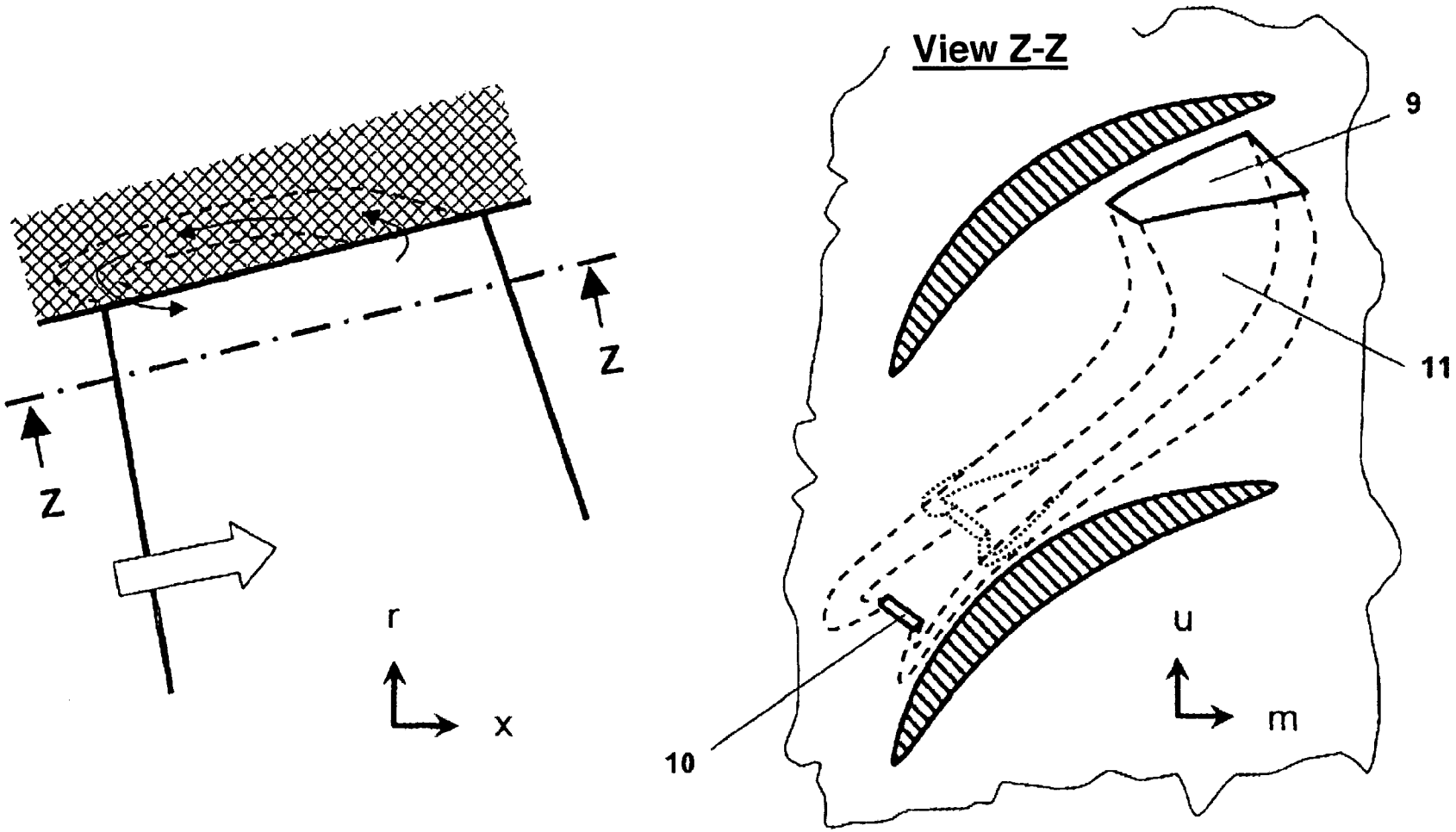
Figure 7:
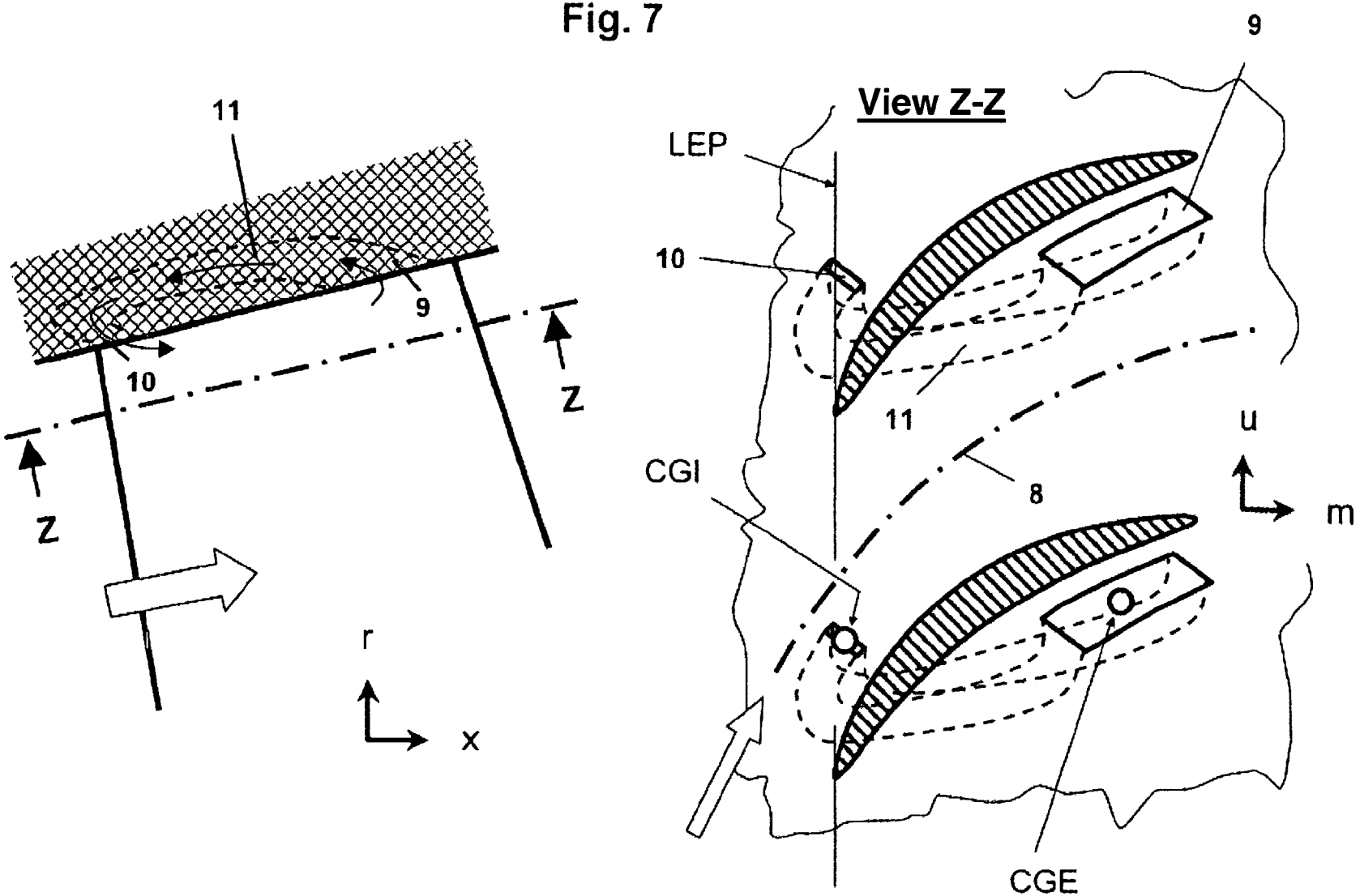
Figure 8:
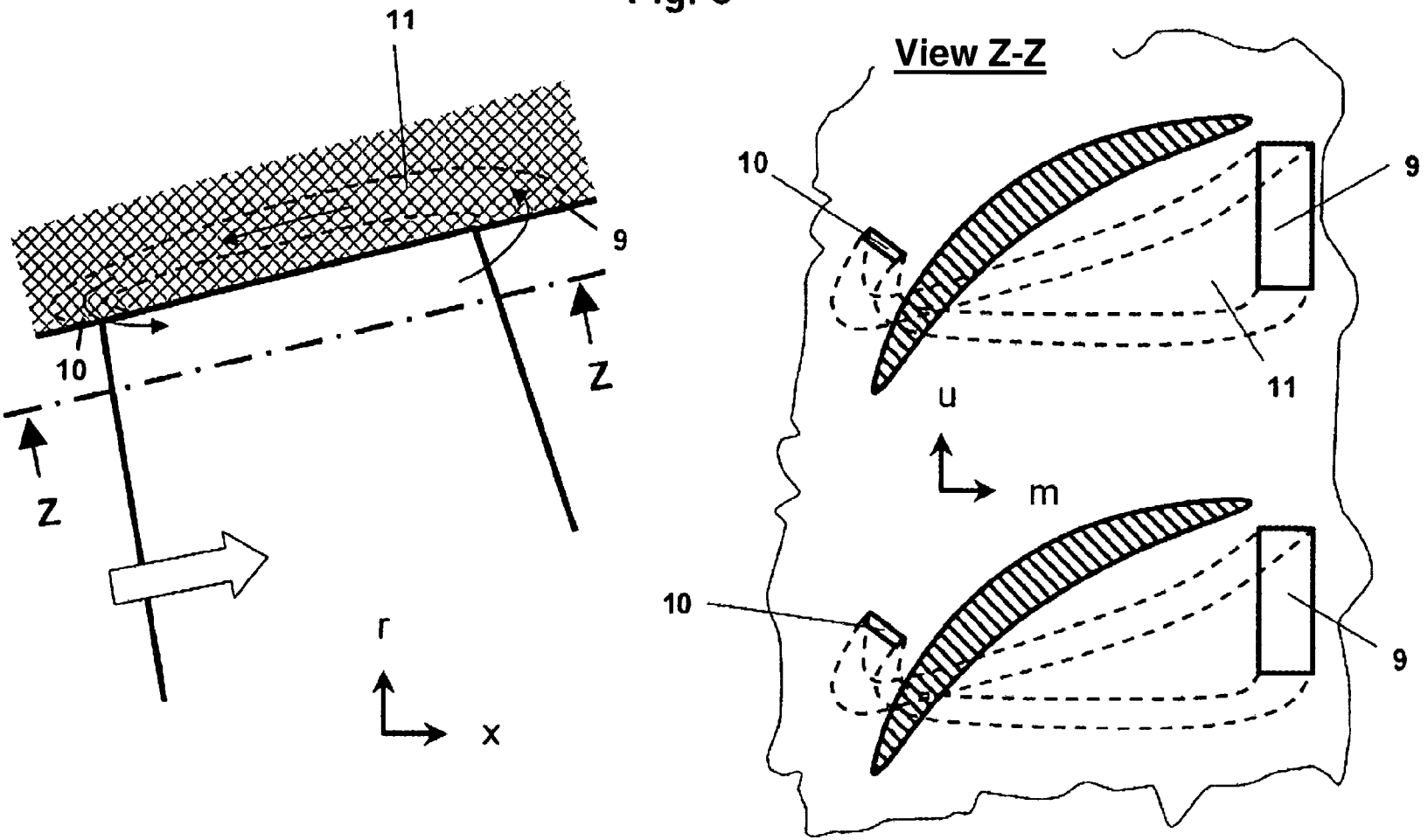
Figure 9:
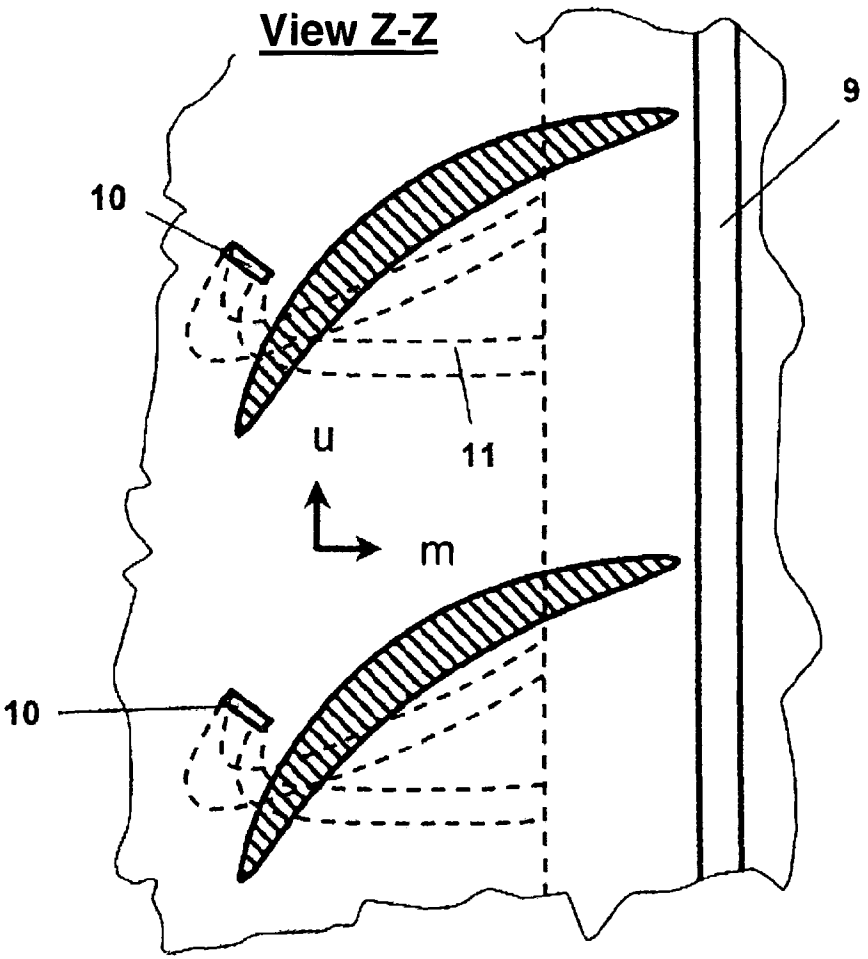
Figure 9:
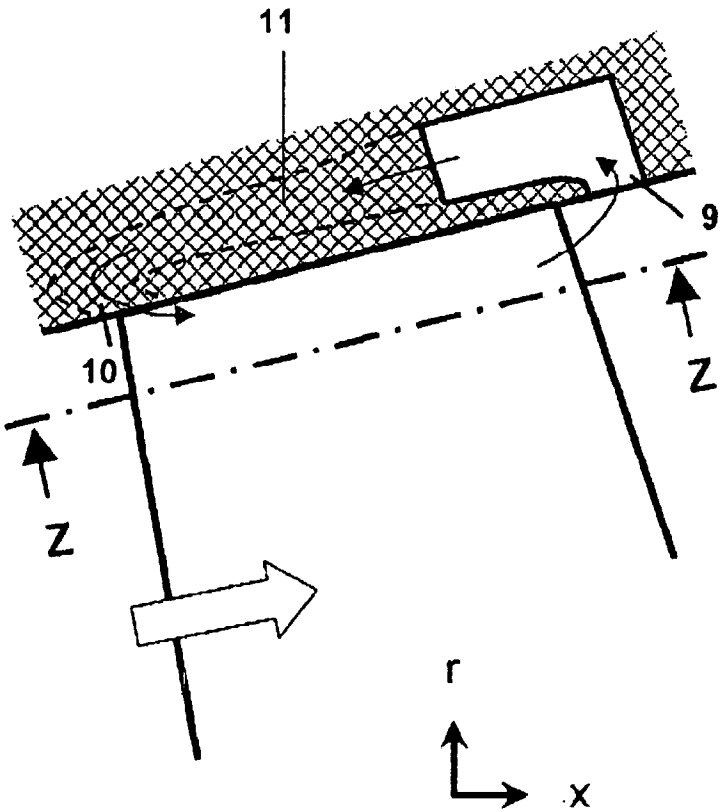
Figure 10:
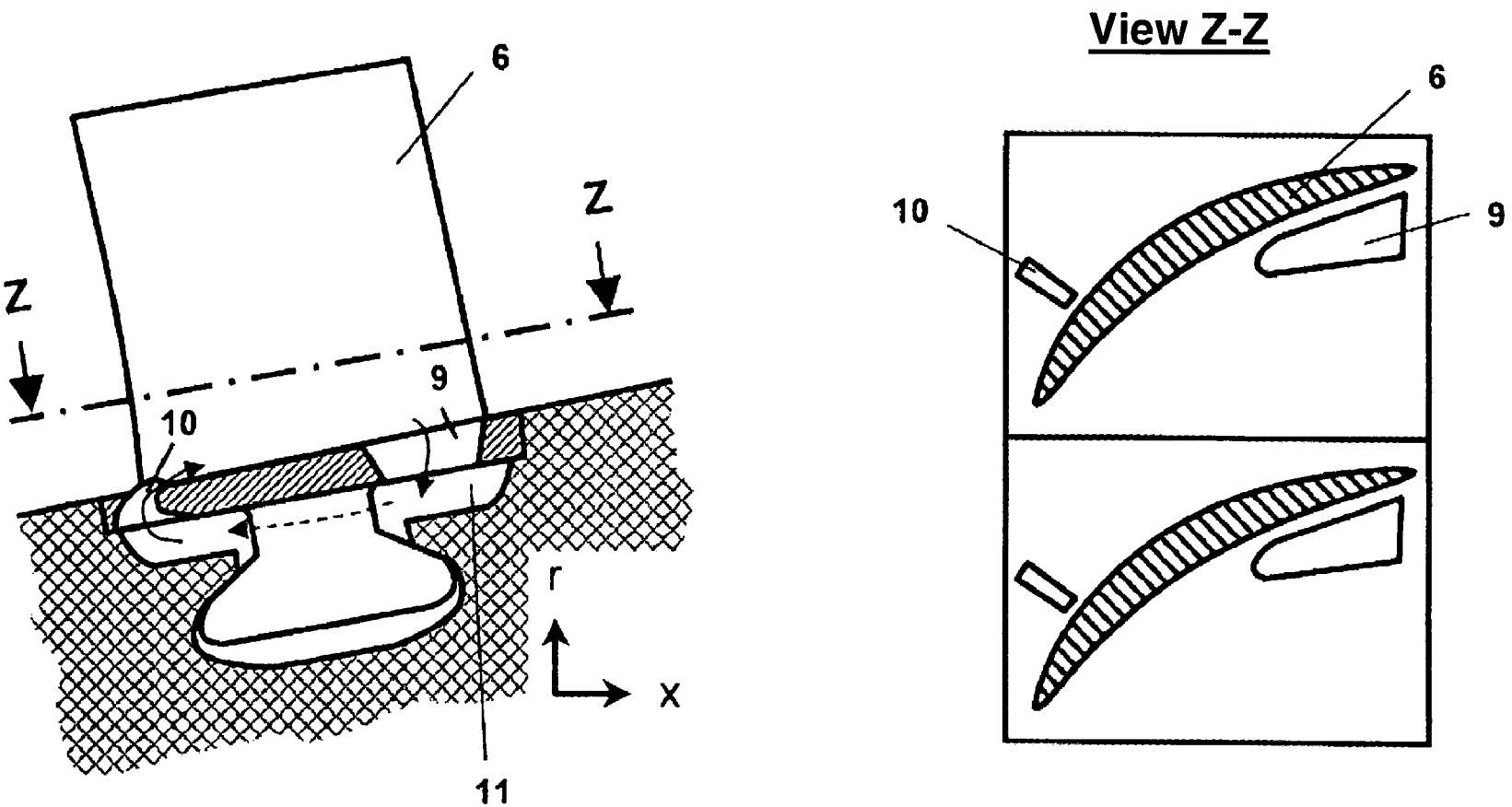
Figure 11:
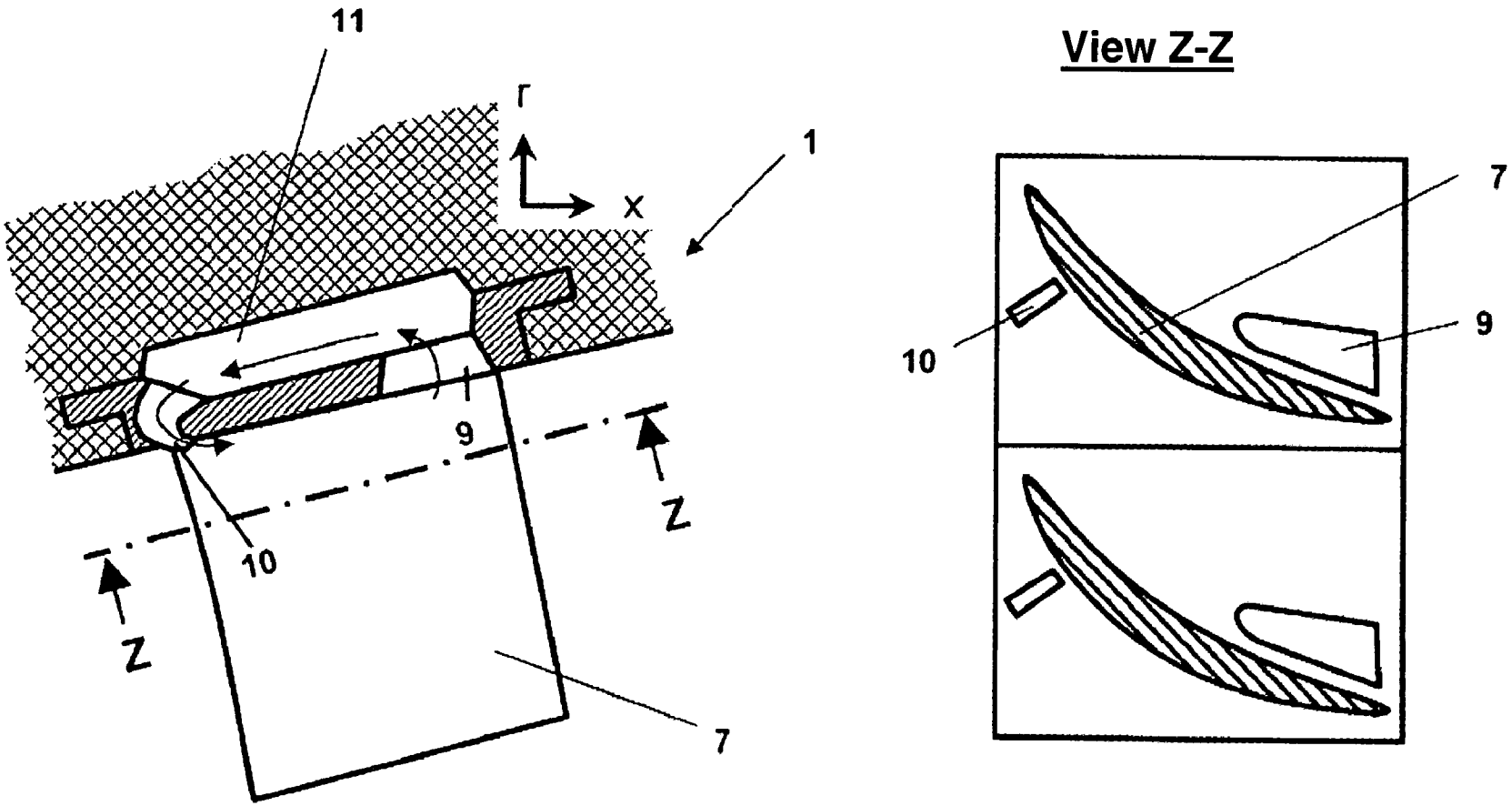
Figure 12:
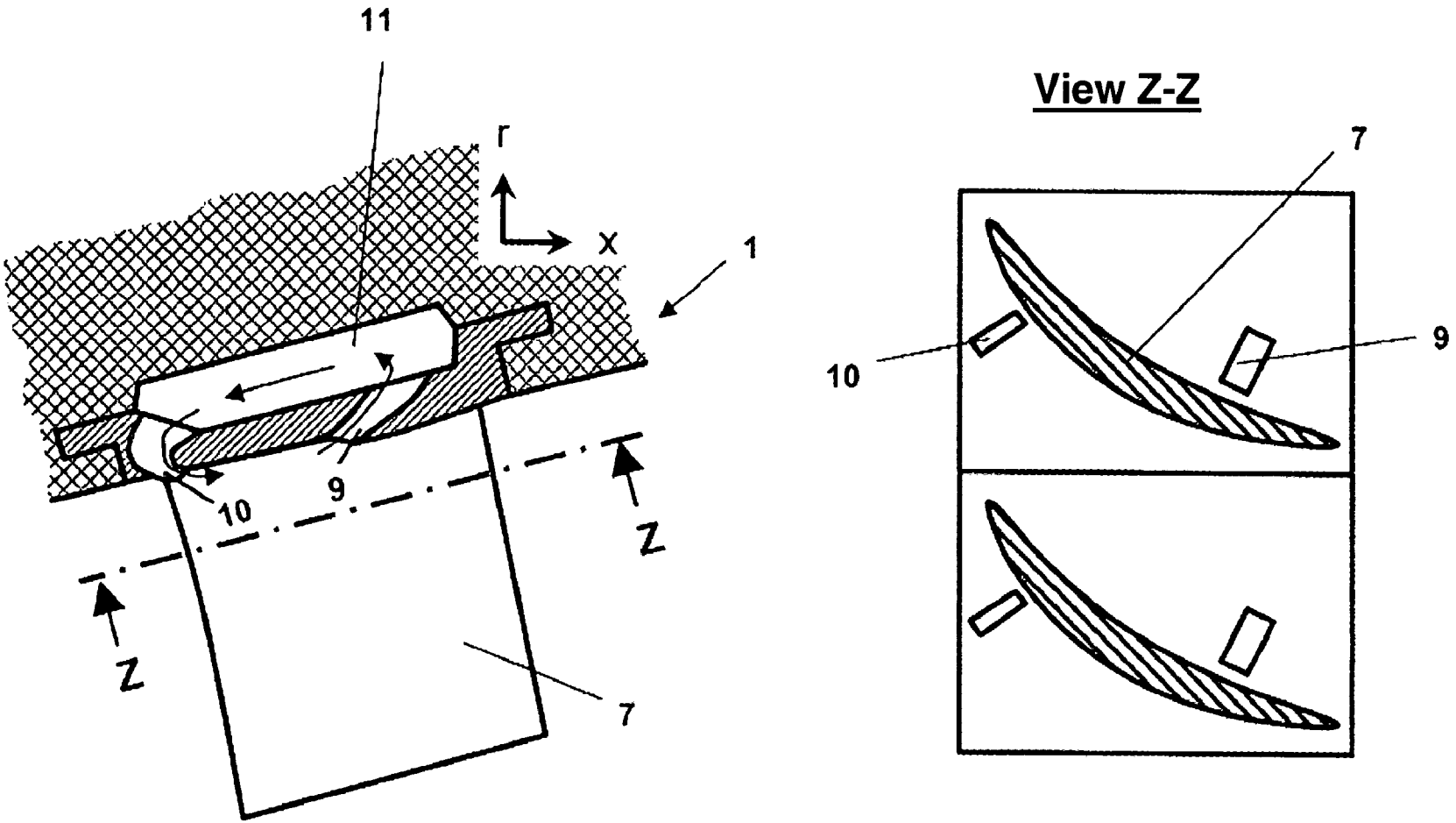
Figure 13:
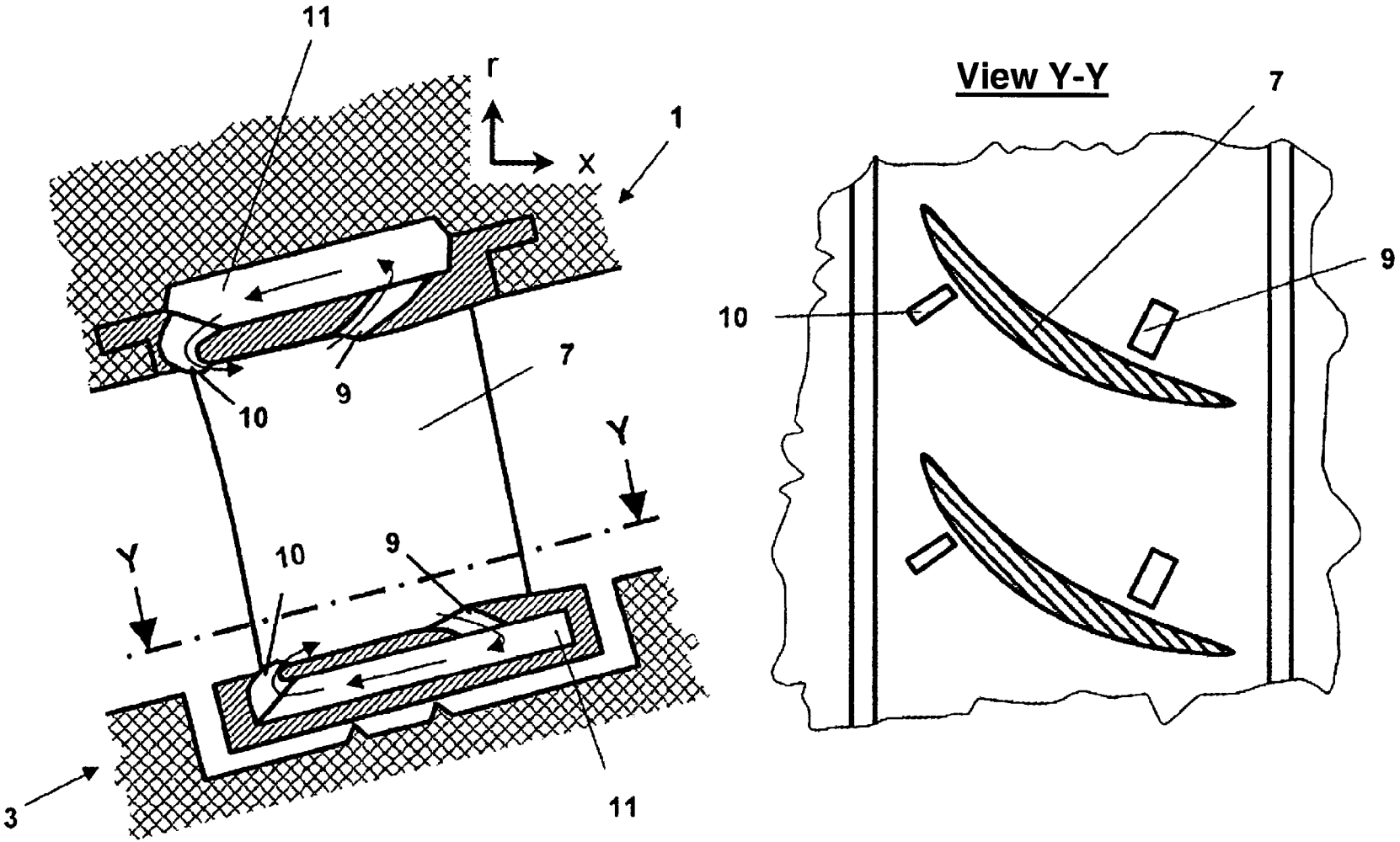
Figure 14:
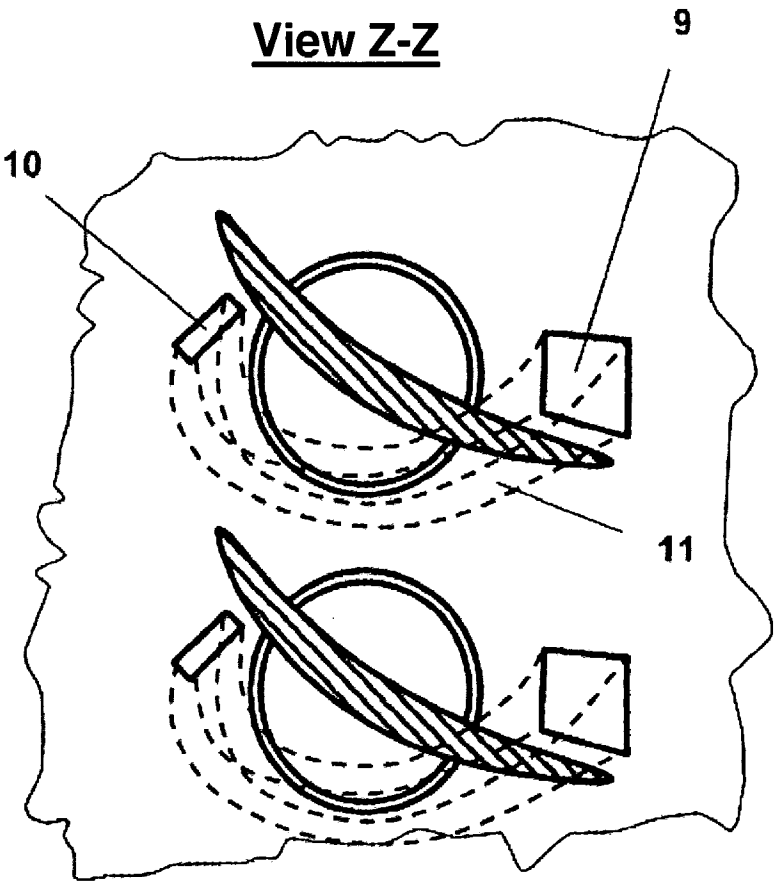
Figure 14:
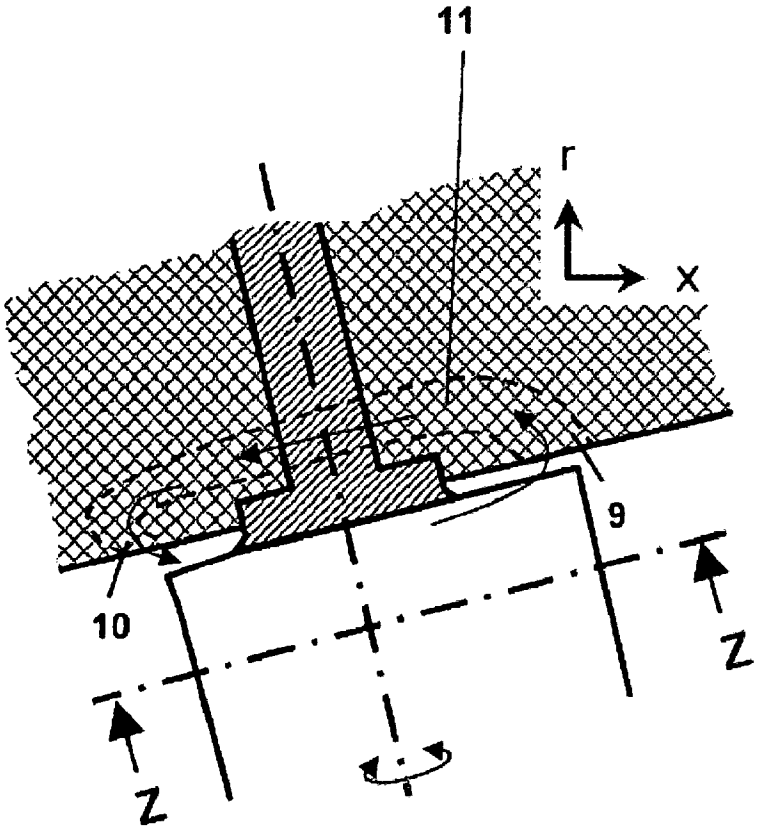
Figure 15:
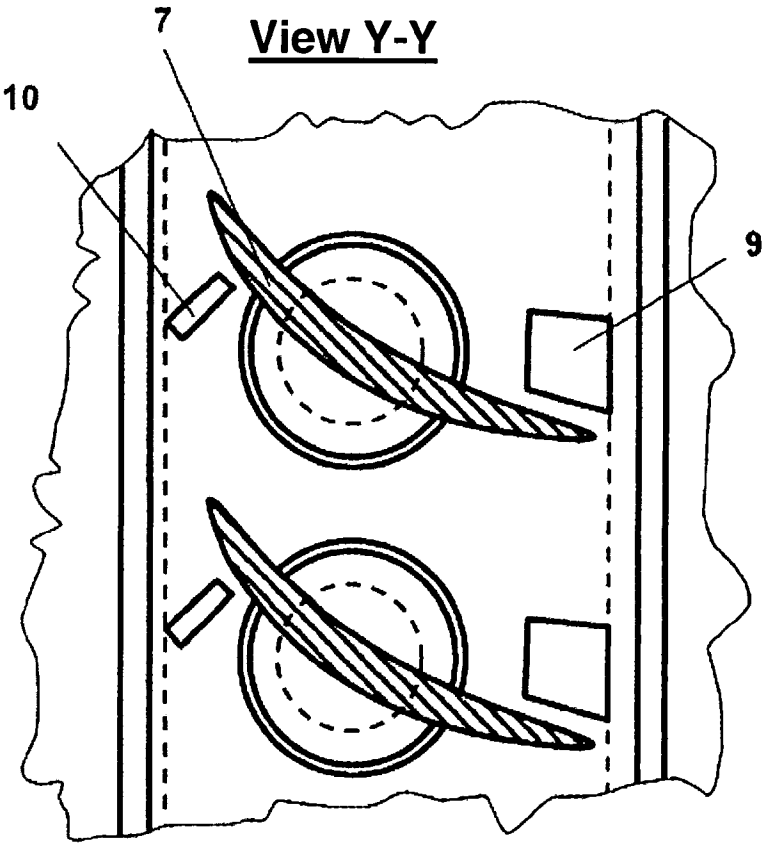
Figure 15:
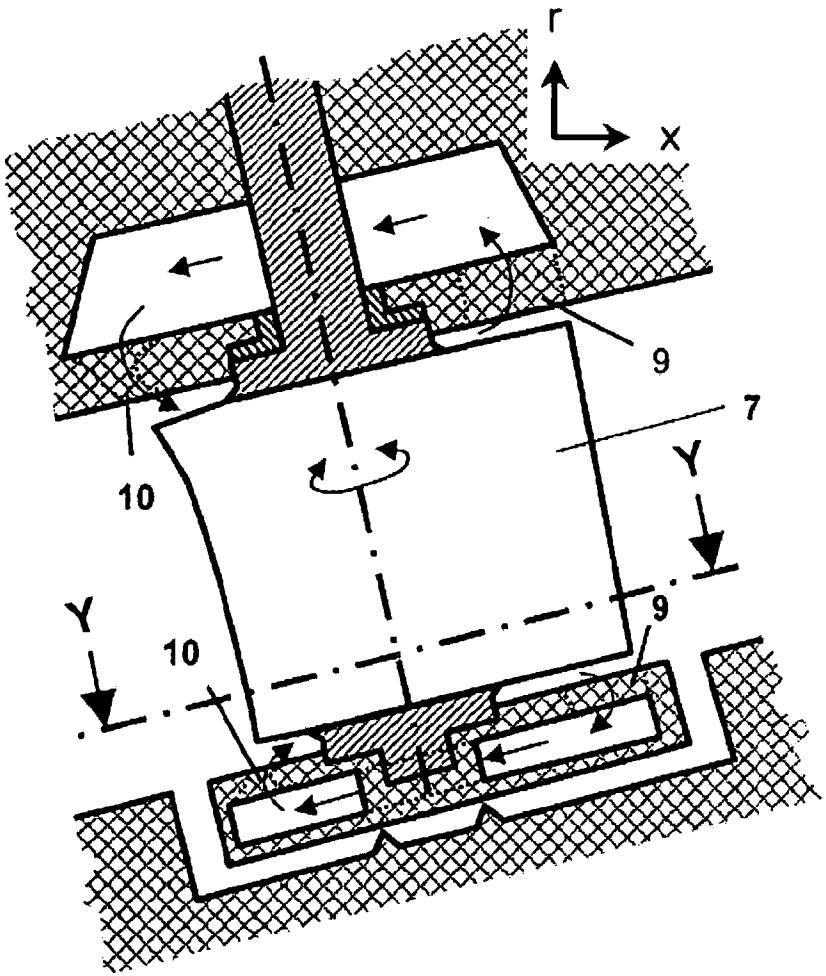

The present invention is more fully described in light of the accompanying drawings showing preferred embodiments. In the drawings, FIG. 1 is a schematic drawing of a fluid flow machine, for example, of a compressor, FIG. 2 (PRIOR ART) shows the state of the art with fluid being returned from blade row to blade row, FIG. 3 (PRIOR ART) shows the state of the art with casing treatment, FIG. 4 shows an offtake zone in accordance with the present invention with sidewall fluid return, FIG. 5 shows a supply zone in accordance with the present invention with sidewall fluid return, FIG. 6 shows a fluid return arrangement at the fixed blade end in accordance with the present invention within a blade passage via individual openings, FIG. 7 shows a fluid return arrangement at the fixed blade end in accordance with the present invention from blade passage to blade passage via individual openings, FIG. 8 shows a fluid return arrangement at the fixed blade end in accordance with the present invention from the outlet to the blade passage via individual openings, FIG. 9 shows a fluid return arrangement at the fixed blade end in accordance with the present invention from the outlet to the blade passage via a circumferential chamber, FIG. 10 shows a fluid return arrangement in accordance with the present invention on the example of a rotor with platform and circumferential root, FIG. 11 shows a fluid return arrangement in accordance with the present invention on the example of a stator with platform and circumferential root, FIG. 12 shows a fluid return arrangement in accordance with the present invention on the example of a stator with platform and circumferential root, variant with removal via ram inlet, FIG. 13 shows a fluid return arrangement in accordance with the present invention on the example of a stator with hub shroud, variant with removal via ram inlet, FIG. 14 shows a fluid return arrangement in accordance with the present invention at the rotatably borne blade end, from blade passage to blade passage via individual openings, and FIG. 15 shows a fluid return arrangement in accordance with the present invention on the example of a variable stator.

FIG. 1 schematically shows a fluid flow machine in meridional view, here the example of a compressor including an annulus duct 2 which is confined inwardly by a hub contour 3 and outwardly by a casing contour 1 and is provided with a number of rotor blade rows 6 and stator vane rows 7 within the annulus duct 2 or the main flow path, respectively. Non-bladed spaces exist between the blade rows 6, 7. As indicated by the large arrow (FIG. 2), the fluid flow machine is flown from the left-hand side. The fluid return arrangement according to the present invention relates to all areas of the sidewalls (hub 3 or casing 1) in which a blade end is provided without relative movement between the blade row and adjoining sidewall, see the marked areas.

Figure 2:
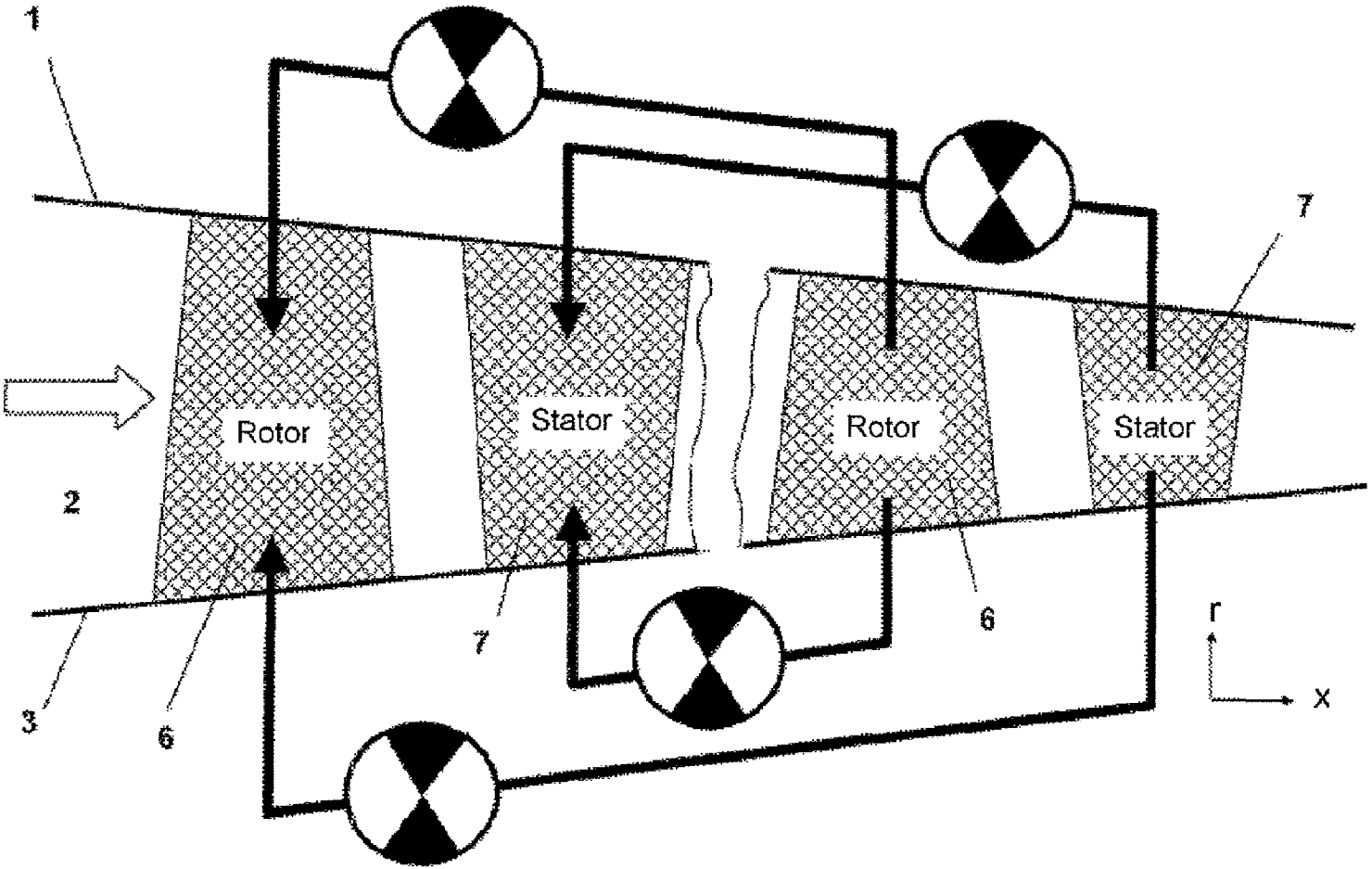

FIG. 2 (PRIOR ART) shows different types of fluid recirculation according to the state of the art, from blade row to blade row, if applicable between blade rows of the same or different type (rotor 6 or stator 7).

Figure 3:
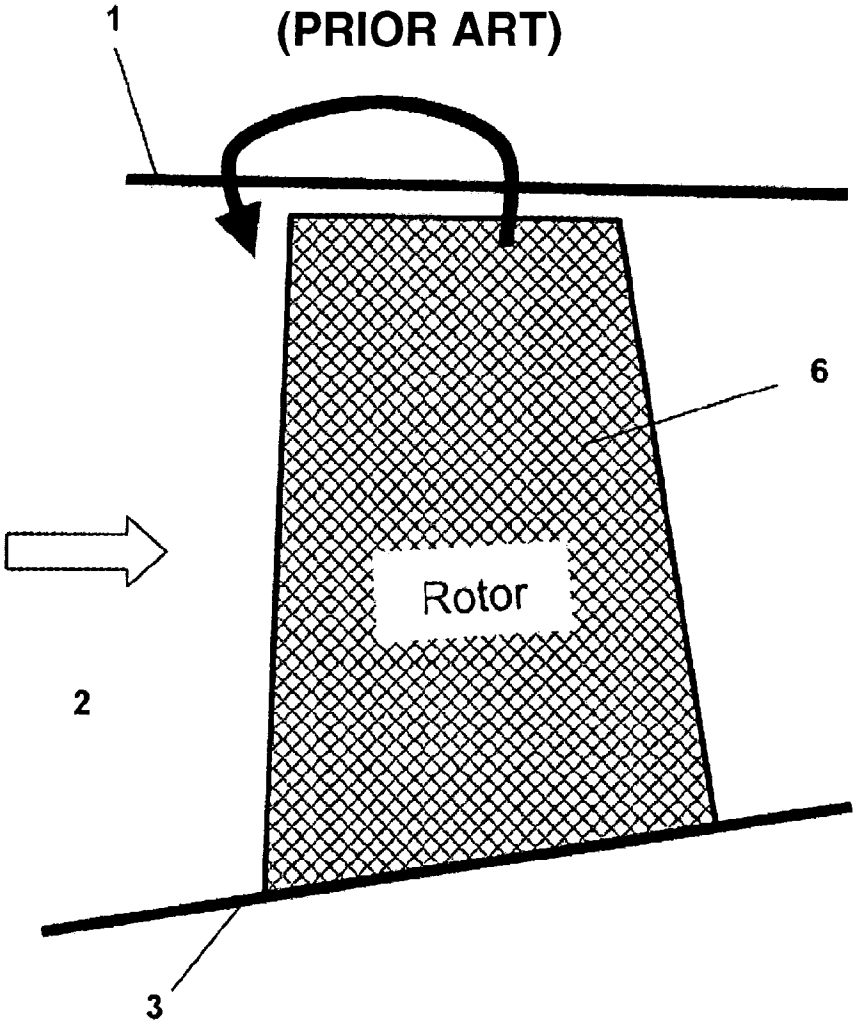
Fig. 3 (PRIOR ART)

FIG. 3 (PRIOR ART) schematically shows a further category of fluid return arrangements according to the state of the art. They all relate to arrangements of rotors 6 with radial gap and relative movement between rotor 6 and surrounding casing 1. Here, air is recirculated from a location above the rotor 6 to a location near the rotor leading edge.

FIG. 4 shows, on the left-hand side, the area of a blade end without circumferential relative movement between blade and the sidewall confining the main flow path. The fluid return arrangement according to the present invention provides for removal and supply of the fluid in defined zones of the sidewall in the area of respectively the same blade row. The right-hand side of FIG. 4 shows the view Z-Z, i.e. a section through the blade row looking on the sidewall and the blade passage situated between two blades in a plane set up by the circumferential direction u and the meridional direction m. The flow approaches the blade row from the left. Here, two fluid offtake zones are defined, both of which are essentially supported on the profile pressure side: an extensive offtake zone EA1 in which removal is advantageous and a further restricted offtake zone EA2 which is situated within EA1 and in which removal is particularly favorable.

The extensive offtake zone EA1 is limited by:

a.) a rectilinear connection between the point A located 0.5 $C_M$ upstream of the trailing edge plane on the profile suction side and the opposite profile leading edge point L; $C_M$ designates the meridional length of the blade profile on the sidewall, b.) the profile pressure side PS, c.) a rectilinear connection between the trailing edge point T1 and the point B located 0.3 $C_M$ downstream of T1 in the meridional flow direction, d.) a rectilinear connection between the point B and the point C located at the same meridional coordinate, but offset from B in the circumferential direction and in the direction of the adjacent suction side by the blade pitch $S_O$, e.) a rectilinear connection between the point C and the trailing edge point T2 located at this meridional coordinate, f.) the rear part of the profile suction side SS between the trailing edge point T2 and the point A.

The restricted offtake zone EA2 is limited by:

a.) a portion of the profile pressure side in the area between the trailing edge plane and a plane located 0.75 $C_M$ upstream of the trailing edge plane in the meridional direction, b.) a rectilinear connection between the points D and E, with the point D being 0.75 $C_M$ upstream of the trailing edge plane in the meridional direction and $0.35*S_O$ remote from the pressure side PS in the circumferential direction, and with the point E being located in the trailing edge plane and 0.5 $S_O$ remote from the pressure side PS in the circumferential direction, c.) a rectilinear connection between point D and the profile pressure side PS in the circumferential direction, d.) a rectilinear connection between point E and the trailing edge point T1 in the circumferential direction, FIG. 5, as FIG. 4, shows on the left-hand side the area of a blade end without circumferential relative movement between blade and the sidewall confining the main flow path. The right-hand side of FIG. 5 shows the view Z-Z, i.e. the blade passage in the plane set up by the circumferential direction u and the meridional direction m, now with two fluid supply zones which both are essentially supported on the profile suction side: an extensive supply zone IA1 in which supply is advantageous and a further restricted supply zone IA2 which is situated within IA1 and in which supply is particularly favorable.

The extensive supply zone IA1 is limited by:

a.) a rectilinear connection between the leading edge point L1 and the point F located 0.3 $C_M$ upstream of L1 in the meridional direction; CM designates the meridional length of the blade profile on the sidewall, b.) a rectilinear connection between the point F and the point G, which is 0.3 $C_M$ upstream of the leading edge point L2 in the meridional direction, c.) a rectilinear connection between point G and the leading edge point L2, d.) a rectilinear connection between the leading edge point L2 and the point H located in the trailing edge plane at a distance of 0.6 $S_O$ from the opposite profile suction side, e.) a rectilinear connection between point H and the trailing edge point T, f.) the profile suction side SS.

The restricted supply zone IA2 is limited by:

a.) a rectilinear connection between the leading edge point L1 and the point F located 0.3 $C_M$ upstream of L1 in the meridional direction; $C_M$ designates the meridional length of the blade profile on the sidewall, b.) a rectilinear connection between the point F and the point I located at the same meridional coordinate and 0.6 $S_O$ remote from the point F in the circumferential direction, c.) a rectilinear connection between the point I and the point J located 0.7 $C_M$ downstream of the leading edge plane and, relative to the trailing edge point T, being offset to the adjacent profile pressure side by 0.4 $S_O$ in the circumferential direction, d.) a rectilinear connection between point J and the profile suction side in the circumferential direction, e.) a portion of the profile suction side in the area between the leading edge plane and a plane located 0.7 $C_M$ downstream of the leading edge plane in the meridional direction.

FIG. 6 shows a blade row-internal fluid return arrangement according to the present invention. The left-hand side of the Figure shows the arrangement in the meridional plane set up by the axial coordinate x and the radial coordinate r. A flow path is provided in the area of the sidewall of the blade row shown, which enables fluid to be returned from an individual opening in the offtake zone according to the present invention to an individual opening in the supply zone according to the present invention. The return flow path is shown as a broken line, as it extends over an area of the circumference which is not fully representable in this view. Further characteristics of the fluid return arrangement are shown in the right-hand part of the Figure. There, the arrangement is shown in view Z-Z. Fluid can enter from the main flow path of the fluid flow machine into an opening in the vicinity of the profile pressure side of a blade, is conveyed through a flow duct into the vicinity of the profile suction side of the adjacent blade and supplied there to the main flow path essentially tangentially to the sidewall. Here, it is advantageous according to the present invention that the offtake opening has a larger cross-sectional area than the supply opening, thereby providing for continuous contraction of the return flow path.

The solution according to the present invention with a single supply opening is shown with bold lines, but, as indicated by thin, dotted lines, at least one branching of the return flow path can exist to supply at least one further supply opening, with all supply openings being provided in the supply zone according to the present invention.

FIG. 7 shows an alternative solution for a fluid return arrangement according to the present invention. Here, fluid enters from the main flow path of the fluid flow machine into an opening in the vicinity of the profile pressure side of a blade, is conveyed through a flow duct into the vicinity of the profile suction side of the same blade and supplied there to the main flow path essentially tangentially to the sidewall. When viewed in the plane set up by the circumferential direction u and the meridional direction m (see right-hand part of FIG. 7), the return flow path and the outline of the blade profile intersect each other. Also indicated in the right-hand part of the Figure is the centerline of the passage between two adjacent blade profiles. It is particularly advantageous in accordance with the present invention if in a blade passage the offtake opening and the supply opening there located are arranged on different sides of the passage centerline. Furthermore, it is particularly effective in accordance with the present invention if, looking in the meridional flow direction m, the centroid of the fluid supply opening designated CGI is located upstream of the centroid of the fluid offtake opening designated CGE. Moreover, it is advantageous in accordance with the present invention if the fluid supply opening is provided at least partly downstream of the leading edge plane LEP. Although omitted in FIG. 7, at least one branching of the return flow path for the supply of at least one further supply opening can exist here as well.

FIG. 8 shows a fluid return arrangement similar to FIG. 7, but with provision being made here for a removal downstream of the trailing edge, not within the blade passage.

FIG. 9 shows a fluid return arrangement similar to FIG. 8, but with provision being made here for removal downstream of the trailing edge by a chamber 9 which extends over the entire circumference of the main flow path and from which individual ducts 11 for the supply of several supply openings 10 branch off in the further course of flow return.

FIG. 10 shows a solution for a fluid return arrangement according to the present invention on the example of a rotor with blade platform and circumferential blade roots. The rotor blades 6 are mounted in a hub, with the hub and the blade platform forming a chamber outside the main flow path. In each blade platform, one offtake opening 9 and one supply opening 10 are provided which enable fluid to be exchanged through the chamber beneath the platform. The supply opening is provided here as a nozzle protruding into the main flow path.

FIG. 11 shows a solution for a fluid return arrangement according to the present invention on the example of a stator with vane platform and circumferential vane roots. The stator vanes 7 are mounted in a casing 1, with the casing and the vane platform forming a chamber 11 outside the main flow path. In each vane platform, one offtake opening 9 and one supply opening 10 are provided which enable fluid to be exchanged through the chamber 11 above the platform. The supply opening 10 is provided here as a nozzle protruding into the main flow path.

FIG. 12 shows an arrangement similar to FIG. 11, but with the offtake opening 9 being provided here as a ram inlet protruding into the main flow path.

FIG. 13 again shows a fluid return arrangement on the stator, now on both the casing side and the hub side of the main flow path. On the hub side, the stator 7 is provided with an inner shroud relative to which the rotor drum surrounded by it performs a rotary movement. Connection between offtake and supply openings can, as shown in the FIGS. 6 to 9, be provided in the form of a number of individual ducts 11 or, as shown here in FIG. 13, be accomplished by means of a chamber 11 provided within the shroud and extending along the circumference. The supply opening 10 is provided here as a nozzle protruding into the main flow path, the offtake opening 9 as a ram inlet protruding into the main flow path. View Y-Y shows a blade section looking on the shroud and the openings for fluid return.

FIG. 14 shows a solution for a fluid return arrangement according to the present invention on the example of a rotatably borne blade end. This can be a combination of rotor blade and hub, a combination of stator vane and casing or a combination of stator vane and inner shroud. The left-hand part of the Figure shows fluid return in the area of the rotatable blade end. The fluid is conveyed from the offtake opening 9 to the supply opening 10, bypassing the setting axis of the blade. In the example here shown, both openings are provided flush with the main flow path. View Z-Z shown in the right-hand half of the Figure (blade section looking on the main flow path wall and the rotary disks of the blades) shows a possible course of the return path. The blade profiles are here shown in the design position and would move over the openings when being varied in part-load operation.

FIG. 15 shows a solution for a fluid return arrangement according to the present invention on the example of a variable stator with inner shroud on the hub and rotatable fixation of the blades at both ends. On the outside, the stator vanes 7 are borne in a casing 1 which provides a flow chamber connecting the offtake openings 9 and the supply openings 10. On the inside, the stator vanes are borne in the shroud in which a flow chamber connecting the offtake openings with the supply openings is again provided. Further details of this exemplified arrangement according to the present invention are shown in view Y-Y in the right-hand half of FIG. 15.

LIST OF REFERENCE NUMERALS

1 Casing
2 Annulus duct/flow path/main flow path
3 Rotor drum/hub
4 Machine axis
5 Inlet guide vane assembly
6 Rotor/rotor blade/rotor blade row
7 Stator/stator vane/stator vane row
8 Passage centerline
9 Fluid offtake opening
10 Fluid supply opening
11 Fluid duct/fluid return path

What is claimed is:

1. A fluid flow machine, comprising:
at least one wall;
a main flow path confined by the at least one wall;
at least one row of blades fixedly mounted on the wall;
at least one fluid offtake opening;
at least one fluid supply opening;
at least one fluid return path connecting the at least one fluid offtake opening and the at least one fluid supply opening, the at least one fluid offtake opening and the at least one fluid supply opening being positioned in the wall in an area of the at least one row of blades, with a circumferential extension of the fluid supply opening being less than a distance between two adjacent blades.

2. The fluid flow machine of claim 1, wherein at least one blade of the at least one row of blades has a blade section having a profile camber with an angular difference of at least 35° of tangents drawn on a profile skeleton line at a leading edge and a trailing edge of the blade.

3. The fluid flow machine of claim 1, wherein the at least one fluid offtake opening is positioned within an offtake zone EA1, which is limited by:
a rectilinear connection between the point A located 0.5 $C_M$ upstream of a trailing edge plane on a profile suction side and an opposite profile leading edge point L; $C_M$ designates a meridional length of a blade profile on the wall,
a profile pressure side PS,
a rectilinear connection between a trailing edge point T1 and a point B located 0.3 $C_M$ downstream of T1 in a meridional flow direction,
a rectilinear connection between the point B and a point C located at a same meridional coordinate, but offset from B in a circumferential direction and in a direction of an adjacent suction side by a blade pitch $S_O$,
a rectilinear connection between the point C and a trailing edge point T2 located at this meridional coordinate, and
a rear part of a profile suction side SS between the trailing edge point T2 and the point A.

4. The fluid flow machine of claim 3, wherein the at least one fluid offtake opening is positioned within an offtake zone EA2, which is limited by:
a portion of the profile pressure side in an area between the trailing edge plane and a plane located 0.75 $C_M$ upstream of the trailing edge plane in the meridional direction,
a rectilinear connection between points D and E, with the point D being 0.75 $C_M$ upstream of the trailing edge plane in the meridional direction and 0.35 $S_O$ remote from a pressure side PS in the circumferential direction, and with the point E being located in the trailing edge plane and 0.5 $S_O$ remote from the pressure side PS in the circumferential direction,
a rectilinear connection between point D and the profile pressure side PS in the circumferential direction, and
a rectilinear connection between point E and the trailing edge point T1 in the circumferential direction.

5. The fluid flow machine of claim 4, wherein the at least one fluid supply opening is positioned within a supply zone IA1, which is limited by:
a rectilinear connection between a leading edge point L1 and a point F located 0.3 $C_M$ upstream of L1 in the meridional direction,
a rectilinear connection between the point F and a point G, which is 0.3 $C_M$ upstream of a leading edge point L2 in the meridional direction,
a rectilinear connection between point G and the leading edge point L2,
a rectilinear connection between the leading edge point L2 and a point H located in the trailing edge plane at a distance of 0.6 $S_O$ from an opposite profile suction side,
a rectilinear connection between point H and a trailing edge point T, and
a profile suction side SS.

6. The fluid flow machine of claim 5, wherein the at least one fluid supply opening is positioned within a supply zone IA2, which is limited by:
a rectilinear connection between the leading edge point L1 and the point F located 0.3 $C_M$ upstream of L1 the in the meridional direction,
a rectilinear connection between the point F and a point I located at the same meridional coordinate and 0.6 $S_O$ remote from the point F in the circumferential direction,
a rectilinear connection between the point I and a point J located 0.7 $C_M$ downstream of the leading edge plane and, relative to the trailing edge point T, being offset to an adjacent profile pressure side by 0.4 $S_O$ in the circumferential direction,
a rectilinear connection between point J and the profile suction side in the circumferential direction, and
a portion of the profile suction side in the area between the leading edge plane and a plane located 0.7 $C_M$ downstream of the leading edge plane in the meridional direction.

7. The fluid flow machine of claim 1, wherein a centroid of the at least one fluid supply opening, as viewed in a meridional flow direction, is provided upstream of a centroid of the at least one fluid offtake opening.

8. The fluid flow machine of claim 1, wherein the at least one fluid offtake opening and the at least one fluid supply opening provided in a blade passage are positioned on different sides of a blade passage centerline.

9. The fluid flow machine of claim 1, wherein the at least one fluid supply opening is at least partly provided downstream of a leading edge plane of the at least one row of blades.

10. The fluid flow machine of claim 1, wherein the at least one fluid return path connects at least one fluid offtake opening with at least one fluid supply opening in another blade passage.

11. The fluid flow machine of claim 1, wherein the at least one fluid return path connects at least one fluid offtake opening with at least one fluid supply opening in a same blade passage.

12. The fluid flow machine of claim 1, wherein the fluid return path is positioned on at least one of a rotor blade row and a stator vane row including at least one individual blade with blade platform, the blade platform forming at least one cavity positioned beside the main flow path, with the at least one fluid supply opening connecting the at least one cavity with the main flow path being provided in the blade platform.

13. The fluid flow machine of claim 12, wherein the at least one fluid offtake opening connecting the main flow path with the at least one cavity is provided in the at least one blade platform.

14. The fluid flow machine of claim 12, wherein the at least one fluid offtake opening connecting the main flow path with the at least one cavity is provided between at least one blade platform and at least one of a rotor drum and the casing.

15. The fluid flow machine of claim 1, wherein at least one blade of the at least one row of blades is variable about a blade rotary axis, with at least one cavity positioned beside the main flow path and passed by the blade rotary axis being provided in at least one of the casing and a rotor drum, with at least one of the at least one fluid supply opening and the at least one fluid offtake opening being provided in at least one blade passage to connect the main flow path with the cavity.

16. The fluid flow machine of claim 1, wherein the wall is partly formed by an inner shroud of at least one blade of a blade row, with at least one cavity positioned beside the main flow path being provided in the inner shroud, and with at least one of the at least one fluid supply opening and the at least one fluid offtake opening being provided in at least one blade passage to connect the main flow path with the cavity.

17. The fluid flow machine of claim 1, wherein the at least one fluid supply opening includes a curved nozzle protruding into the main flow path.

18. The fluid flow machine of claim 1, wherein the at least one fluid offtake opening includes a curved ram inlet protruding into the main flow path.

19. The fluid flow machine of claim 1, wherein the at least one fluid supply opening is positioned within a supply zone IA1, which is limited by:

- a rectilinear connection between a leading edge point L1 and a point F located 0.3 $C_M$ upstream of L1 in the meridional direction; $C_M$ designates a meridional length of a blade profile on the wall,
- a rectilinear connection between the point F and a point G, which is 0.3 $C_M$ upstream of a leading edge point L2 in the meridional direction,
- a rectilinear connection between point G and the leading edge point L2,
- a rectilinear connection between the leading edge point L2 and a point H located in the trailing edge plane at a distance of 0.6 $S_O$ from an opposite profile suction side,
- a rectilinear connection between point H and a trailing edge point T, and
- a profile suction side SS.

20. The fluid flow machine of claim 19, wherein the at least one fluid supply opening is positioned within a supply zone IA2, which is limited by:

- a rectilinear connection between the leading edge point L1 and the point F located 0.3 $C_M$ upstream of L1 the in the meridional direction,
- a rectilinear connection between the point F and a point I located at the same meridional coordinate and 0.6 $S_O$ remote from the point F in the circumferential direction,
- a rectilinear connection between the point I and a point J located 0.7 $C_M$ downstream of the leading edge plane and, relative to the trailing edge point T, being offset to an adjacent profile pressure side by 0.4 $S_O$ in the circumferential direction,
- a rectilinear connection between point J and the profile suction side in the circumferential direction, and
- a portion of the profile suction side in the area between the leading edge plane and a plane located 0.7 $C_M$ downstream of the leading edge plane in the meridional direction.

* * * * *